US006676420B1

(12) United States Patent
Liu et al.

(10) Patent No.: US 6,676,420 B1
(45) Date of Patent: Jan. 13, 2004

(54) DOUBLE INTERFACE COMPACT FLASH MEMORY CARD

(76) Inventors: Wen-Tsung Liu, Fifth Floor, No. 1, Lane 45, Pao-Hsing Road, Hsin-Tien, Taipei Hsien (TW), 231; Chia-Li Chen, Fifth Floor, No. 1, Lane 45, Pao-Hsing Road, Hsin-Tien, Taipei Hsien (TW), 231

( * ) Notice: Subject to any disclaimer, the term of this patent is extended or adjusted under 35 U.S.C. 154(b) by 0 days.

(21) Appl. No.: 10/216,612

(22) Filed: Aug. 12, 2002

(30) Foreign Application Priority Data

Apr. 19, 2002 (TW) ..... 91205364 U

(51) Int. Cl.[7] ..... H01R 13/44
(52) U.S. Cl. ..... 439/131; 439/946
(58) Field of Search ..... 439/131, 76.1, 439/946, 945

(56) References Cited

U.S. PATENT DOCUMENTS 6,116,927 A * 9/2000 Johnson et al. ..... 439/131
6,190,184 B1 * 2/2001 Cimbal et al. ..... 439/131
6,375,479 B1 * 4/2002 Johnson et al. ..... 439/131
6,439,900 B1 * 8/2002 Sward ..... 439/131

* cited by examiner

*Primary Examiner*—Gary Paumen

(57) ABSTRACT

A double interface compact flash memory card includes a frame and a USB interface unit. The frame contains at least a flash memory chip and a bridge circuit board module, a compact flash memory interface at one side, and a socket at the other side. The socket can accommodate a USB interface unit at one side thereof. The USB interface unit has several positioning grooves at the hinge end, which can be caught with a locating projection on the socket so that the USB interface can be located at different angular positions as desired.

8 Claims, 3 Drawing Sheets

DOUBLE INTERFACE COMPACT FLASH MEMORY CARD

BACKGROUND OF THE INVENTION

1. Field of the Invention

The present relates to a compact flash memory card, in particular, to a double interface compact flash memory card that can fix a USB interface at different angular positions.

2. Description of Related Art

With development of technology, electronic appliances supporting multimedia technologies such as computers, digital cameras, MP3 Players and etc. become more and more popular. The demand of consumers on digital data storage devices grows rapidly. However, there are more and more storage-devices of different specifications, sizes, and models emerging in today's world, such as hard disks, recorded compact disks, storage media and etc.

Currently, different storage media such as PCMCIA Card, Compact Flash Memory (CF) Card, Smart Media Card, Multimedia Card, Secure Digital Card, and Memory Stick Card and etc., are taking the position of conventional storage media such as diskette or hard disk due to their smallness and lightness, and are favored by more and more consumers. In above memory cards, the Compact Flash Memory Card is widely used in multimedia products due to its high capacity. However, a legacy Compact Flash Memory Card only has a dedicated compact flash memory interface (50 pins), thus it can't be used in digital products adopting other interfaces. This situation brings inconvenience to consumers.

Recently, a newly developed interface, Universal Serial Bus (USB) interface, has been adopted in various digital products and is favored by more and more customers.

A type of USB supports plug-and-play and hot swapping, and can be used directly in multimedia products without the need of driver installation and additional power supply unit. Hence, the USB can provide high data transmission rate and high compatibility. By now, the USS has become a standard device in computers and multimedia products.

From above introduction, we can see that a compact flash memory card and a USB card are state of the art in today's data storage industry. However, there are still many problems related with these two product exist, such as:

1. Both of them usually are designed independently to be suitable for being used separately.

2. It is not possible for the conventional USB interface being turned with a function of angular adjustment so that a more convenient application is unable to reach.

In consideration of above problems, the inventor invents a double interface compact flash memory card, which can support both the compact flash memory interface and the USB interface and it is possible for the USB interface being fixed at different angular positions.

SUMMARY OF THE INVENTION

A main object of the present invention is to provide a double interface compact flash memory card that has both a compact flash card and a USB interface and the USB interface can be turned and adjusted to different angular positions.

To attain the above purpose, the double interface compact flash memory card of the invention includes a frame and a USB interface unit. The frame receives a flash memory and the circuit board module. The frame at a lateral side thereof has a compact flash memory interface at one side thereof and a socket at the opposite other side. The USB interface can be inserted in the socket and can be turned horizontally. The USB interface unit has several positioning grooves at one end, which can be blocked and fixed by a corresponding flange on the socket at several directions.

BRIEF DESCRIPTION OF THE DRAWINGS

The detail structure, the applied principle, the function and the effectiveness of the present invention can be more fully understood with reference to the following description and accompanying drawings, in which.

DETAILED DESCRIPTION OF THE PREFERRED EMBODIMENT

Figure 1:
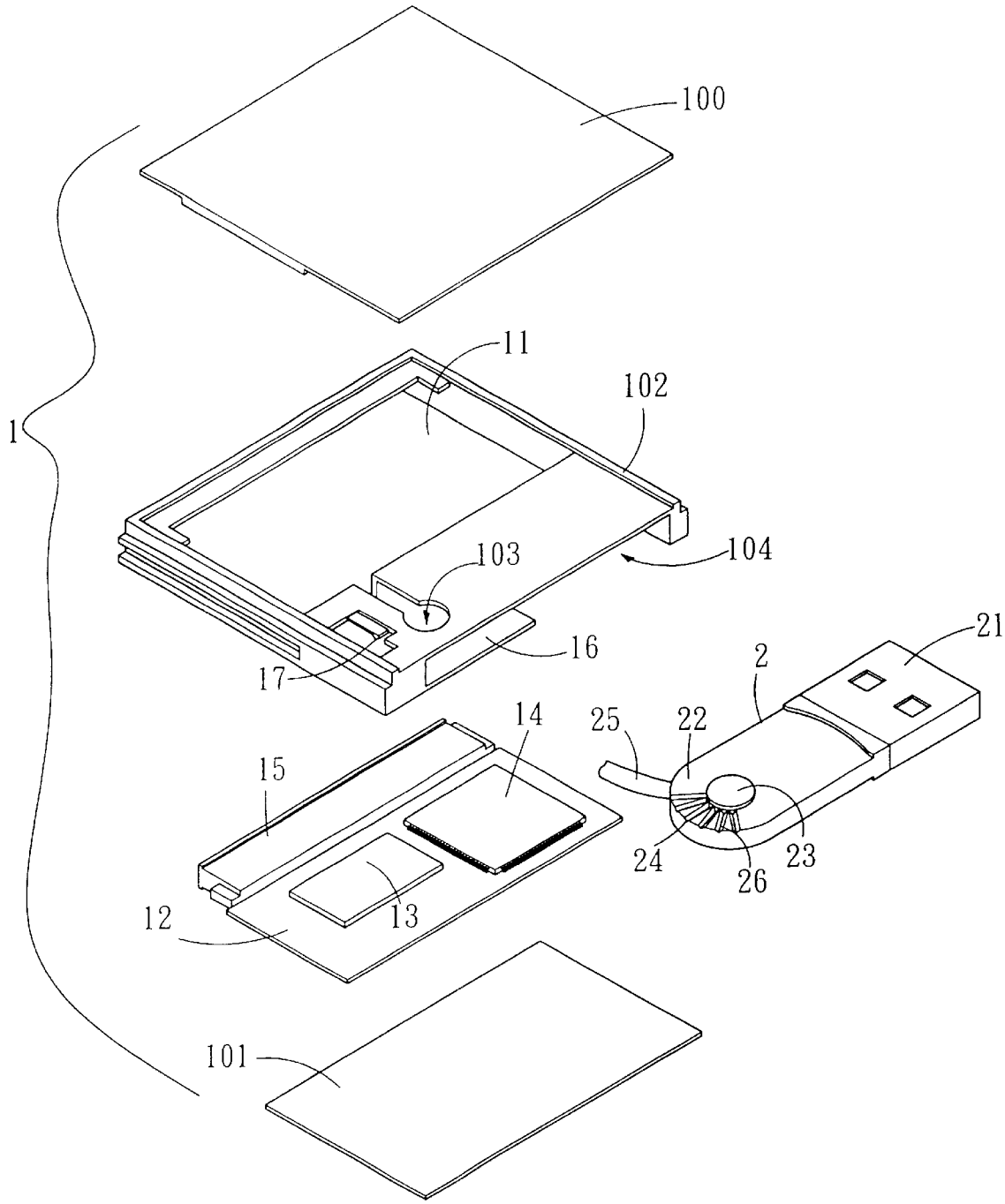
FIG. 1 is a perspective exploded view of a double interface compact flash memory card of this invention.
Figure 2:
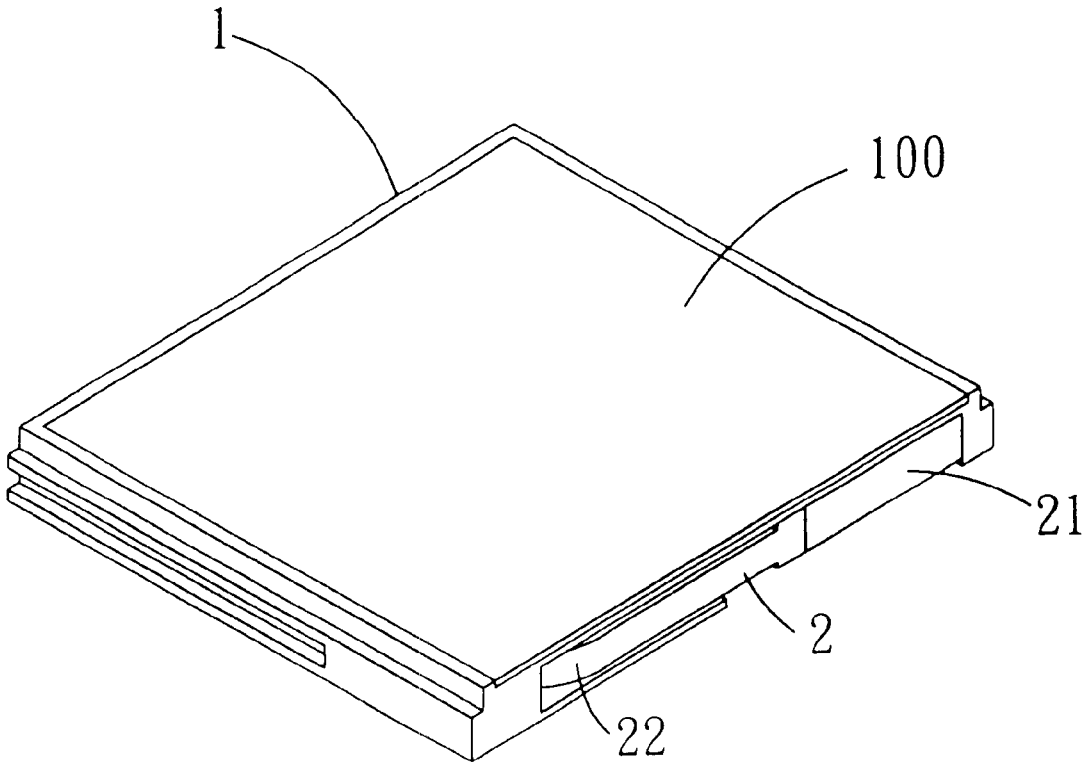
FIG. 2 is a perspective view of the double interface compact flash memory card of this invention.
Figure 3:
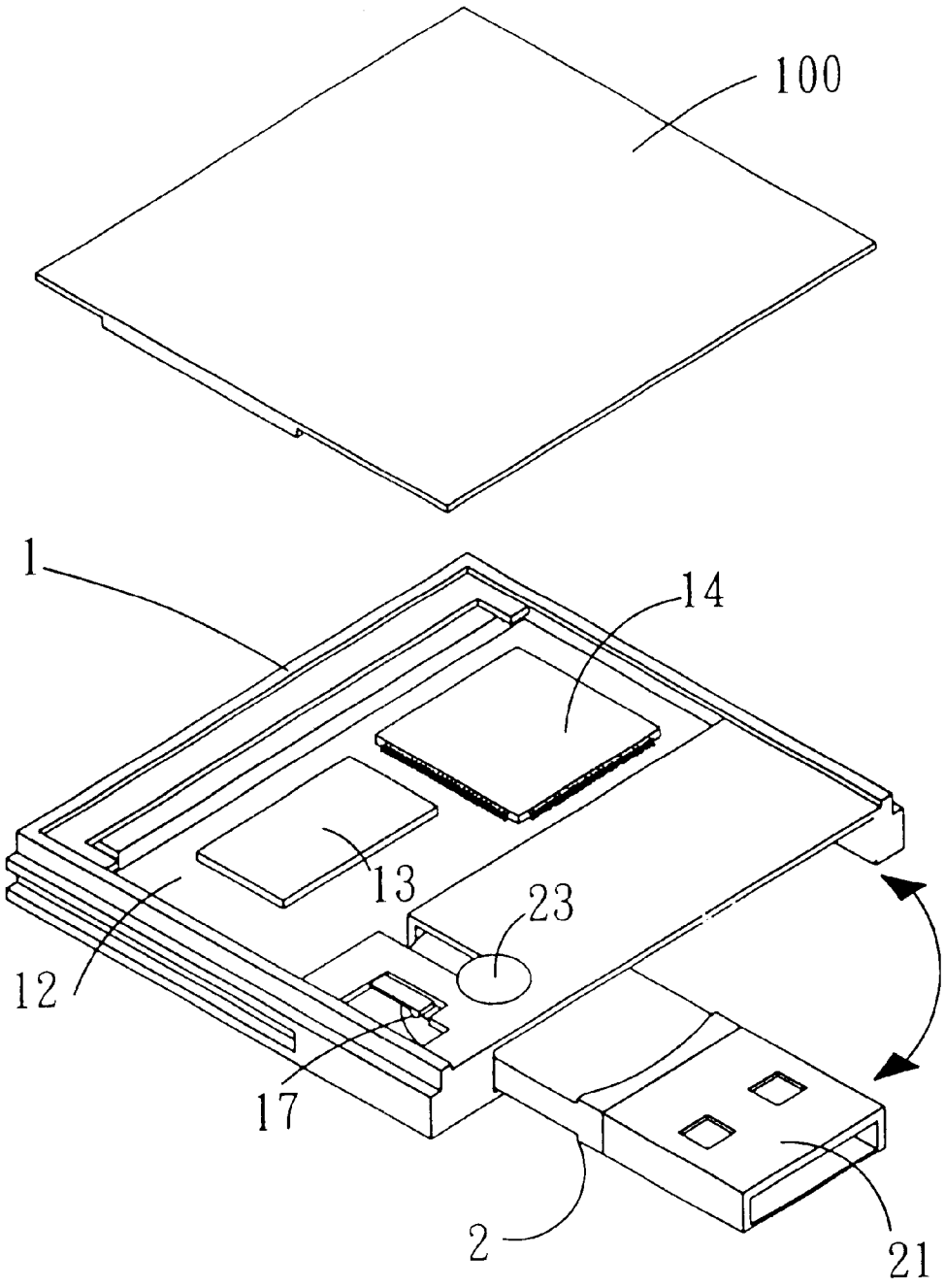
FIG. 3 is a perspective view illustrating a USB interface unit in the double interface compact flash memory card of the invention in a state being actuated.

Please referring to FIGS. 1 and 2, the invention comprises a frame (1) and a USB interface unit (2). The frame (1) is a rectangle structure, and it encloses a space (11), which can contain a circuit board (12). The circuit board (12) has at least a flash memory chip (13) and a bridge chip (14). The frame (1) has a COMPACT FLASH MEMORY Interface (50 pins) (15) at one end and a socket (16) at the other end. The socket (16) has a positioning flange (17).

The USB interface unit (2) has a plug structure (21) at one end and a hinge shaft (23) at the other end (hinge end) (22) The USB interface unit (2) can be inserted into the socket (16) of the frame (1) and hinged on one side of the socket (16) via the pivot (23) at the hinge end (22). In this way, the USB interface unit (2) can be turned away from the socket (16) with the pivot (23) serving as a pivot point. The hinge end (22) of the USB interface unit (2) has several positioning grooves (24), which can be caught by the locating projection (17) of the socket (16) to fix the USB interface (2) at different angular positions.

In the preferred embodiment of the invention, the frame consists of an upper cover plate (100), a lower cover plate (101), and a main body (102). The main body (102) encloses a space (11), which can receive a circuit board (12). The circuit board (12) has at least a flash memory chip (13) and a bridging chip (14). The main body (102) has a compact flash memory interface (15) connected to the circuit board (12) at one end thereof and a socket (16) at the other end thereof. The socket (16) is used for accommodating the USB interface unit (2). The socket (16) has a pivot hole (103) at the top thereof and a resilient locating projection (17) near the pivot hole (103). The main body (102) has a guiding gap (104) on the top or on the bottom thereof for guiding the USB interface unit (2) out.

The USB interface unit (2) has a plug structure (21) at one end thereof and a hinge end (22) at the other end thereof with a cable (25) therein being connected to the circuit board (12). The hinge end (22) has a pivot (23), which can be inserted into the pivot hole (102) of the main body (102). In this way, the USB interface unit (2) can be turned away from the socket (16) with the hinge shaft (23) serving as a pivot point. The hinge end (22) of the USB interface unit (2) has several radial grooves (26). Each locating groove (24) can be caught with the locating projection (17) of the main body (102) to fix the USB interface (2) at different angular positions as desired. In actual applications, the user can push the USB interface unit (2) away from the socket (16) and fix it at an expected angular position to couple the plug (21) of the USB interface unit (2) with a digital product. Thus, the double interface compact flash memory card can exchange data with multimedia products not only via the compact flash memory interface thereof but also via the flexible USB interface unit (2).

Because the USB interface unit (2) is completely enclosed in the socket (16) of the frame (1), the frame (1) behaves as a standard compact flash memory card, which can be inserted into a socket of any multimedia product (e.g., DSC, Mp3 Players and etc.).

From above description we can see that the double interface compact flash memory card of this invention can obtain expected purposes and meets all requirements for being granted a patent.

While the invention has been described with referencing to a preferred embodiment thereof, it is to be understood that modifications or variations maybe easily made without departing from the spirit of this invention, which is defined by the appended claims.

What is claimed is:

1. A double interface compact flash memory card, comprising a frame, being a standard compact flash memory card size containing a circuit board module, a compact flash memory interface at a lateral side thereof, and a socket with a positioning projection at an opposite lateral side thereof; and a USB interface unit;

characterized in that the USB interface unit is received in the socket and an end of the USB interface unit is hinged at one side of the socket such that the USB interface unit is completely enclosed in the frame; and the USB interface unit has a plurality of positioning grooves at the hinged end thereof, which can be caught by a locating projection on the socket during pivoting.

2. The double interface compact flash memory card as defined claim 1, wherein the frame is composed of an upper cover plate, a lower cover plate and a main body with the main body being sandwiched by the upper and the lower cover plates.

3. The double interface compact flash memory card as defined in claim 2, wherein the main body has a containing space to receive at least a flash memory chip and a circuit board bridging a chip.

4. The double interface compact flash memory card as defined in claim 1, wherein the frame has a hinge hole near the socket and the locating projection is resilient and near the hinge hole.

5. The double interface compact flash memory card as defined in claim 1, wherein the frame has a guiding gap above the socket for guiding USB interface unit moving outwardly.

6. The double interface compact flash memory card as defined in claim 5, wherein the frame has a guiding gap below the socket instead for guiding USB interface unit moving outwardly.

7. The double interface compact flash memory card as claim 1, wherein the hinged end of the USB interface unit has a pivot, which can be engaged to the pivot hole of the main body.

8. The double interface compact flash memory card as defined in claim 1, wherein the positioning grooves are arranged as a plurality of radial grooves.

* * * * *